United States Patent [19]

Richards

[11] Patent Number: 4,941,995

[45] Date of Patent: · Jul. 17, 1990

[54] NATURAL PRESERVATIVE COMPOSITION FOR WET WIPES

[75] Inventor: Marc F. Richards, Dover, Del.

[73] Assignee: Scott Paper Company, Philadelphia, Pa.

[21] Appl. No.: 215,196

[22] Filed: Jul. 5, 1988

[51] Int. Cl.[5] ..... A61F 13/15

[52] U.S. Cl. ..... 252/407; 426/655

[58] Field of Search ..... 252/398, 407; 426/655, 426/651

[56] References Cited

U.S. PATENT DOCUMENTS 3,037,975 6/1962 Cohn ..... 426/655
4,508,747 4/1985 Ziegler ..... 426/655
4,615,937 10/1986 Bouchette .
4,732,797 3/1988 Johnson et al. .
4,865,855 9/1989 Hansen et al. ..... 426/124

OTHER PUBLICATIONS

The Chemistry and Manufacture of Cosmetics, pp. 85–109, M. Denavarre, Second Edition, 1975, vol. III.

Chemie Research and Manufacturing, Co., Inc., Technical Bulletin for Product P-50, Distrtibuted Prior to 2/25/87, 8 pp.

*Primary Examiner*—John S. Maples
*Assistant Examiner*—Valerie Denise Fee
*Attorney, Agent, or Firm*—John A. Weygandt; John W. Kane, Jr.

[57] ABSTRACT

A preservative composition for a wet wipe product comprising carboxylic acids and grapefruit seed extract.

11 Claims, No Drawings

NATURAL PRESERVATIVE COMPOSITION FOR WET WIPES

BACKGROUND OF THE INVENTION

Field of the Invention

The present invention relates to wet wipes, more particularly to a natural preservative composition for such wipes.

Wet wipe products require preservatives in their aqueous phase to destroy or inhibit the growth of various microorganisms such as bacteria, yeasts and molds. The use of a chemical preservative agent dispersed or dissolved in the aqueous phase of a wet wipe lotion has become the conventional means for inhibiting microbiological activity. Recently, it has become commercially desirable to develop and market wet wipe products preserved with chemicals which are "natural", i.e., found in or derived from products of nature.

On such natural preservative is described and claimed in U.S. Pat. No. 4,732,797, granted Mar. 22, 1988 to Johnson et al. Johnson et al describe a wet wipe product comprising a liquid preservative composition having, as its sole active ingredients, citric acid and sorbic acid. Sorbic acid as a preservative for a wet wipe product has an esthetic and functional disadvantage: it is susceptible to oxidation and its oxidation products are yellow in color. Consequently, it tends to break down over time and color the wipe yellow unless some preventative measure is taken. Johnson et al. deal with this problem by protecting the sorbic acid with a high ratio, viz. 10 to 1, of citric acid, which protects the sorbic acid from oxidation (c.f., Johnson et al., Column 3, line 66 through Column 4, line 5). However, such a high proportion of citric acid means that in order to have an effective amount of sorbic acid present in the lotion, the amount of citric acid will be so high as to represent a threat to the physical integrity of the fibrous web unless the web is strongly bonded with an acid resistant binder. By following the teachings of the present invention, the need for sorbic acid as a component of the preservative composition can be reduced or eliminated.

SUMMARY OF THE INVENTION

The present invention provides a preservative composition which may consist essentially of natural ingredients and which is as effective in inhibiting the growth of undesirable microorganisms as any conventional preservative composition. The essential components of the preservative composition are (a) one or more carboxylic acids and (b) grapefruit seed extract. Preferably, one of the carboxylic acids is an aromatic carboxylic acid, especially benzoic, or salicylic. In such case, the composition also includes citric acid as an adjuvant to the antimicrobial effect of the aromatic carboxylic acid.

"Grapefruit seed extract" is a commercially available product formed by extracting the seeds of grapefruit with propylene glycol and/or glycerine. Its recommended application is as a preservative in the cosmetic industry and has been assigned FDA No. R 0013982. "Grapefruit seed extract" is an approved name for designation of ingredients for cosmetics under the Food and Drug Administration, 21 CFR 701.3(c)(2)(i), being defined in the Cosmetic Ingredient Dictionary. Its antimicrobially active ingredients are evidently soluble in propylene glycol and/or glycerine. Applicant is informed that this extract comprises various naturally occuring salts of ascorbic acid, as well as various other naturally occuring compounds, including fruit sugars, glucine (an amino acid) and Vitamin E. Certain "essential oils" have been shown to exhibit antimicrobial activity. A definition of essential oils and a description of their antimicrobial activity appears in M. deNavarre *Chemistry and Manufacture of Cosmetics*, Second Edition, 1975, Vol. III, pp. 85–109. See also 46 Agricultural Biological Chemistry 1655–1660 (1982). Without wishing to be bound by theory, applicant speculates that grapefruit seed extract may contain essential oils which exhibit antimicrobial activity in the preservative composition of the present invention.

The wet wipe product preserved with the preservative composition of the present invention is as microbiologically stable as prior art wet wipe products and is as mild or as non-irritating to the skin as any such products. The present invention does not require the inclusion in the lotion of any of the anti-microbial agents conventionally employed heretofore, such as quaternary ammonium compounds, parabens, or the like; nor does it require an antimicrobial agent substantive to the fibers of the wipe, such as that disclosed by Bouchette, U.S. Pat. No. 4,615,937, granted October, 1986.

These and other features and advantages of the present invention will be made more apparent from the following description of the preferred embodiments.

DESCRIPTION OF THE PREFERRED EMBODIMENTS

In accordance with the present invention, the wet wipe product comprises a sheet of wipe cut from a fibrous web and an aqueous lotion for moistening the wipe. The lotion consists primarily of ingredients whose function is to support the primary purpose of the product, namely, cleaning. Such ingredients include surfactants, emollients, skin moisturizers and fragrance compounds. As will be appreciated by one of ordinary skill in the art to which the present invention pertains, the lotion is primarily water, for which reason the product is called a wet wipe.

The fibrous web can be selected from those conventionally known in the art for this purpose. Various synthetic and natural fibers have been effectively used and their selection does not require discussion here. See, for example, Johnson et al., Col. 2, line 46 though Col. 3, line 39, incorporated herein by reference.

In accordance with the present invention, the preservative composition comprises at least two carboxylic acids and grapefruit seed extract. Preferably, one carboxylic acid is an aromatic carboxylic acid (a monocarboxylic acid derivative of the benzene series) especially benzoic or salicylic (ortho-bydroxybenzoic) acid. In said preferred embodiment the composition also includes citric acid as an adjuvant to the antimicrobial effect of the aromatic carboxylic acid. In its most preferred embodiment, the composition includes at least a third acid being a hydroxy acid to further acidify the lotion and add antimicrobial acitivity. Especially, preferred for this purpose are tartaric acid and lactic acid. Dicarboxylic acids having antimicrobial activity may also be included in the composition of the present invention. Succinic acid (butanedioic acid) and glutaric acid (pentanedioic acid), a natural component of many foods are suitable for use as acidulants in the composition of the present invention. Sorbic acid (2,4-hexadienoic acid), a trans-trans unsaturated fatty acid, is only slightly soluble in water. It must be accompanied by other, more soluble acidulants to lower the pH of the lotion to a level at which the acids remain undissassociated.

The carboxylic acids are preferably present in the aqueous lotion in the range of about 0.01 percent to about 2.0 percent by weight of the lotion. The grapefruit seed extract is present in the range of about 0.001 weight percent to about 1.0 weight percent by weight of the lotion. When the preservative composition consists essentially of natural carboxylic acids and grapefruit seed extract, it may be said to be "all natural".

The pH of the lotion is maintained low enough so that the carboxylic acids remain substantially undisassociated. This is typically below about pH 3.5. As taught by Johnson et al, it has been found that such a low pH is relatively non-irritating to the skin.

The preservative composition of the present invention provides excellent preservative activity against various microorganisms, particularly the five pathogenic microorganisms identified in the U.S. Pharmacopeia 28-day challenge test.

As previously mentioned, the selection of the functional components of the wet wipe lotion is well within the skill of one of ordinary skill in the art to which the present invention pertains. The primary growth medium for microorganisms is the cellulose in the fibrous web itself. However, certain ingredients such as skin moisturizers, particularly aloe vera, promote the growth of microorganisms. Accordingly, as will be appreciated by those of ordinary skill, the microbiological stability of the wet wipe product will be determined by the composition of the web and the lotion and the composition and strength of the preservative composition must be adjusted accordingly.

In order to be transported in commerce and sold, the wet wipe product is enclosed within a moisture impervious means of some kind. Typically, the enclosure means for the wet wipe product is a sealed package, such as a tub or canister, plastic envelope or foil packet of the type conventionally used in the art. The present invention is not limited to any particular enclosure means and any known in the art can be used.

The principles, features and advantages of the invention will be further understood upon consideration of the following specific examples.

EXAMPLE 1

Sheets of a latex bonded cellulose fibrous web having a basis weight of 64 g/m$^2$ were impregnated at the rate of 310% saturation or about 200 g/m$^2$ with a lotion consisting of the following ingredients:

| | |
|---|---|
| Salicylic Acid | 0.2% |
| Sorbic Acid | 0.13% |
| Citric Acid | 0.2% |
| Grapefruit Seed Extract | 0.075% |
| Aloe Gel | 0.5% |
| Fragrance | 0.1% |

the balance of the lotion being deionized water.

The wet wipes were tested according to the U.S. Pharmacopeia procedure for the twenty-eight day challenge test to determine the preservative efficacy of the lotion against various microorganisms. The wet wipes were found to exceed the efficacy standards for the minimum inhibitory concentration (MIC) for the five pathogenic microorganisms identified in the test: Aspergillus niger, Candida albicans. Stapholococcus aureus, Pseudomonas aeruginosa, and Esherichia coli. Indeed the lotion of the present example killed the microorganisms (reduced the count to less than 10 colony forming units (cfu) per gram) in three days whereas in U.S. Pharmacopia only requires that the bacteria be reduced 99.9% and the mold and yeast remain at or below initial innoculation levels by day 14.

In the present example, sorbic acid was included at a concentration near its limit of solubility in water (0.16 g per 100 ml at 20° C.) and was protected by a relatively low ratio of citric acid (2 to 1). That proportion would be satisfactory if the wipe were protected from oxygen until just prior to use, viz. if individually wrapped and sealed in a foil packet. However, the wipes of the present example were found to yellow when exposed to air for a few days. By following the teachings of the present invention, this problem can be dealt with either by reducing the amount of sorbic acid and substituting another acid, or by eliminating sorbid acid entirely. In Example 2 which follows sorbic acid was entirely replaced by tartaric acid. However, if it were desired to include some sorbic and adequately protect it from oxidation while keeping the level of citric acid at a level which does not degrade the web, e.g., 0.2%, then using a 6 to 1 ratio, 0.033% sorbic could be included, the tartaric being reduced proportionately to 0.167%. The preservative composition of Example 2 represents the best mode for practicing the invention known to the inventor because it is entirely free of any concern about yellowing of the web, is very effective against microorganisms, is "all natural" and is non-toxic to humans.

EXAMPLE 2

Sheets of a latex bonded cellulose fibrous web having a basis weight of 64 g/m$^2$ were impregnated at the rate of 280% saturation or about 180 g/m$^2$ with a lotion consisting of the following ingredients:

| | |
|---|---|
| Benzoic Acid | 0.2% |
| Tartaric Acid | 0.2% |
| Citric Acid | 0.1% |
| Grapefruit Seed Extract | 0.075% |
| Aloe | 0.5% |
| Fragrance | 0.1% |

the balance of the lotion being deionized water.

The wet wipes were tested according to the U.S. Pharmacopeia procedure for the 28-day challenge test to determine the preservative efficacy of the lotion against various microorganisms. The wet wipes were found to exceed the efficacy standards for the MIC for the five pathogenic microorganisms.

It is apparent that other variations and modifications may be made without departing from the spirit and scope of the present invention. Accordingly, it should be understood that the forms of the present invention described and illustrative and not intended to limit the scope of the invention as defined by the appended claims.

What is claimed is:

1. A preservative composition for an aqueous lotion-impregnated fibrous wipe, comprising at least two carboxylic acids and grapefruit seed extract in an amount between 0.001 and and 1.0% by weight of the aqueous lotion, the pH of said aqueous lotion being adjusted to keep said carboxylic acids undisassociated.

2. The composition of claim 1 wherein a carboxylic acid is an aromatic carboxylic acid.

3. The composition of claim 2 wherein the aromatic carboxylic acid is benzoic.

4. The composition of claim 2 wherein the aromatic carboxylic acid is salicylic acid.

5. The composition of claim 1 wherein a carboxylic acid is a hydroxy acid.

6. The composition of claim 5 wherein the hydroxy acid is taken from the group consisting of lactic, malic, tartaric and citric.

7. The composition of claim 1 wherein the acids further comprise citric acid.

8. The composition of claim 2 wherein the acids further comprise tartaric and citric.

9. The composition of claim 1 wherein the acids are benzoic, tartaric and citric.

10. The composition of claim 1 wherein the acids include citric and at least one other carboxylic acid.

11. The composition of claim 1 consisting essentially of carboxylic acids and grapefruit seed extract.

* * * * *